United States Patent [19]

Buchanan et al.

[11] Patent Number: 5,048,563

[45] Date of Patent: Sep. 17, 1991

[54] STEAM AND FUEL OIL SUPPLY AND PURGE VALVE WITH COOLING STEAM FEATURE

[75] Inventors: Bascom F. Buchanan, Sarasota, Fla.; Joseph R. Buchanan, Portland, Conn.

[73] Assignee: ITT Corporation, New York, N.Y.

[21] Appl. No.: 493,217

[22] Filed: Mar. 14, 1990

[51] Int. Cl.[5] ..... F16K 11/16

[52] U.S. Cl. ..... 137/597; 137/630.22

[58] Field of Search ..... 137/597, 94, 630.22; 431/29, 31, 121

[56] References Cited

U.S. PATENT DOCUMENTS

| | | | |
|---|---|---|---|
| 3,065,783 | 11/1962 | Hindenlang | 431/29 |
| 4,146,056 | 3/1979 | Buchanan | 137/597 X |
| 4,454,892 | 6/1984 | Chadshay | 137/597 |
| 4,579,143 | 4/1986 | Rollins et al. | 137/597 X |
| 4,823,843 | 4/1989 | Golembiski | 431/121 X |

*Primary Examiner*—Stephen M. Hepperle
*Attorney, Agent, or Firm*—McCormick, Paulding & Huber

[57] ABSTRACT

A steam and fuel oil supply and purge valve has a steam valve and actuator member which provides for a closed position, a purge operation with communication established between a steam supply line and a discharge line leading to an oil burner, a burner operation position wherein the actuator portion of the member engages and opens an oil supply valve member and thus establishes communication between an oil supply line and an oil discharge line to the burner. Oil recirculation is also provided together with a "cooling" steam feature. The latter is provided by the steam valve and actuator at an additional position where a metered flow of "cooling" steam is provided for inoperative burner tips when other burners remain in operation.

9 Claims, 6 Drawing Sheets

STEAM AND FUEL OIL SUPPLY AND PURGE VALVE WITH COOLING STEAM FEATURE

BACKGROUND OF THE INVENTION

In the firing of industrial oil burners and auxiliary or igniter burners associated with large oil fired utility or industrial boilers, it is a conventional practice to employ steam as an atomizing agent for the fuel oil. Moreover, the same source of steam is usually employed in purging fuel oil lines for safety and other considerations. A combination valve of the type under consideration and Which controls the supply of both steam and fuel oil during firing and purging operations of burner systems is shown in U.S. Pat. No. 4,146,056 issued Mar. 27, 1979 and entitled STEAM AND FUEL OIL CONTROL AND PURGE VALVE. The valve shown and described in the patent, which is incorporated herein by reference, is particularly well suited to the efficient control of firing and purge operations as aforesaid and is quite satisfactory in all respects. There is, however, one additional feature recently found desirable and which is lacking in the patented valve.

More particularly, if a burner "gun" is not retracted when removed from service while other "guns" are still in operation, the excessive heat encountered can do serious damage to the burner tip. It has been found, however, that it is possible to meter a small flow of steam through the gun and thus relatively "cool" the same and prevent damage thereto.

It is a general object of the present invention to provide a steam and fuel oil supply valve of the type mentioned and which includes a simple and straight- forward means providing for the supply of a metered flow of "cooling" steam to an inoperative burner "gun" and thus prevent damage thereto.

SUMMARY OF THE INVENTION

In fulfillment of the foregoing general object, an improved combination steam and fuel oil supply and purge valve is provided and comprises a valve body defining steam and oil inlet ports and at least one discharge port. An oil recirculation port is also provided. A steam purge passageway interconnects the steam inlet and the discharge port and an oil supply passageway interconnects the oil inlet port and the discharge port. An oil recirculation passageway interconnects the oil inlet port and the oil recirculation port. A cooling steam passageway interconnects the steam inlet port and the discharge port.

A steam valve and actuator member is movable between first, second, third, and fourth positions in the valve body and is operable to open and close the steam purge and cooling steam passageways. An oil valve member which is movable between first and second positions respectively to open and close the oil supply passageway and to close and open the oil recirculation passageway has an associated biasing means which urges the same toward its second position. The steam valve and actuator member in its first and second positions respectively closes and opens the steam purge passageway. In its third position, the steam valve and actuator member closes the steam purge passageway and actuates the oil valve member whereby to urge the latter to its first position in opposition to its biasing means and thereby to open the oil supply passageway and close the oil recirculation passageway. The oil recirculation passageway has a normally open condition when the oil valve member is in its closed position. In its fourth position the steam valve and actuator member allows the oil valve member to close the oil supply passageway and opens the cooling steam passageway.

More particularly, the valve body includes opposed spaced apart first and second valve seats each with a valve opening respectively for the control of supply and recirculation oil flow. The oil inlet port and the oil valve member are disposed between the first and second seats in the valve and the valve member is movable in one and an opposite direction between said first and second positions respectively. The first and second positions respectively represent engagement with the second and first seats whereby to open the oil passageway and close the recirculation passageway and to close the oil supply passageway and open the oil recirculation passageway.

The actuator portion of the steam valve and actuator member preferably takes the form of an elongated plunger which is engagable with the oil valve member and operable to move the same to its first position when the steam valve and actuator resides in its third position. Thus the aforesaid sequence of operation is positively and mechanically assured.

The specific construction of the oil valve member and its associated seats may vary but preferably comprises a plug type valve for a centrally bored oil supply seat. On an opposite side of the oil valve member a flat disc-like valve member is provided and the recirculation seat has a central opening for a valve stem with a plurality of small openings arranged circumaxially thereabout. Thus, the disc-like valve member opens and closes the small openings on engagement with the recirculation valve seat.

Restriction or metering means in the cooling steam passageway preferably takes the form of at least one small metering passageway formed in the valve portion of the steam valve and actuator member. The said passageway is dimensioned and located to open prior to full opening movement of the valve portion of the member.

When steam or perhaps air is required for atomizing, or other purposes, the combination valve of the invention is provided with both steam and oil discharge ports as described. Thus, during a purge operation both steam and oil discharge lines may be supplied with steam or air. During running or firing operation, oil is of course supplied to the oil discharge port and its associated conduit and thence to the burner while steam or air may be supplied to the steam discharge port and its associated conduit.

In an alternative embodiment of the combination valve of the present invention, and when for example mechanically atomized burners are served by the valve, it is only necessary to provide a single discharge port and associated conduit. Thus, during a purge operation, steam or air may be provided from a steam inlet conduit and the associated steam port to the discharge port and its associated conduit. During burner operation, the discharge port and its associated conduit is of course supplied with fuel oil for delivery to the burner.

DESCRIPTION OF PREFERRED EMBODIMENTS

Figure 1:
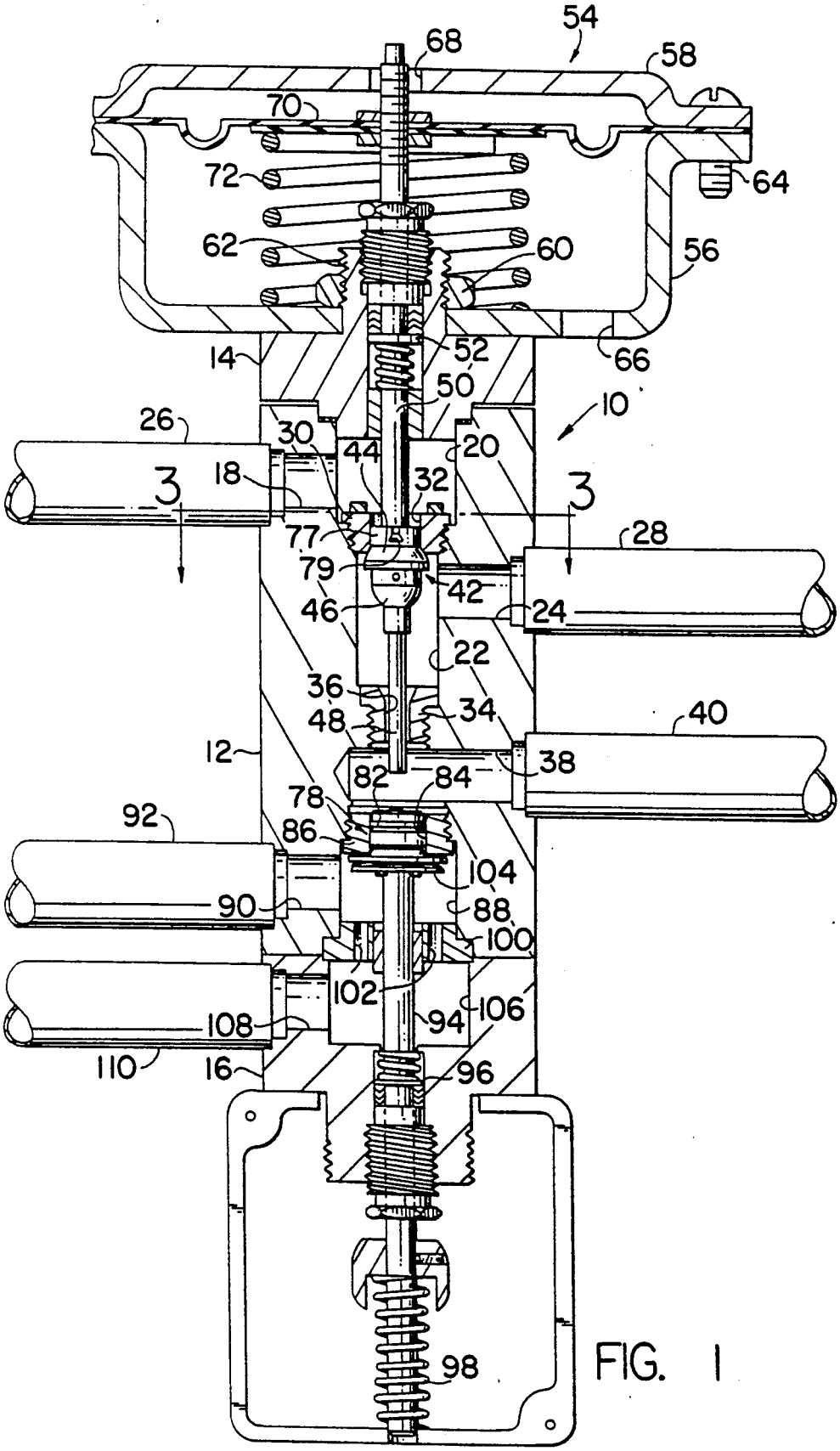
FIG. 1 of the drawings is a vertical sectional view through the improved valve of the present invention and an illustrative actuator associated therewith, various valve members being illustrated in full line in a closed position and in broken line in open positions.

Referring particularly to FIG. 1, a valve constructed in accordance with the present invention is indicated generally at 10 and comprises a central or intermediate body portion 12 which takes a cylindrical form and which has associated upper and lower closure members or plugs 14, 16. The plugs 14, 16 may be secured in assembled position by appropriate screws or the like not shown. A steam inlet port 18 communicates with a steam inlet chamber 20 and a steam discharge chamber 22 communicates with steam discharge port 24. Steam inlet and discharge conduits 26, 28 are associated respectively with the inlet and discharge ports 18, 24.

Steam valve seat 30 has a central axial bore 32 which establishes communication between the steam inlet and discharge chambers 20, 22. At a lower end portion of the chamber 22 purge valve seat 34 has a central axial bore 36 which establishes communication between chamber 22 and an oil discharge port 38 therebeneath. The oil discharge port 38 has a corresponding conduit 40 which extends to an associated burner as does the steam discharge conduit 28.

As will be apparent from the foregoing, a steam supply passageway can be established by the steam inlet or supply conduit 26, steam inlet port 18, steam inlet chamber 20, steam valve bore 32, steam discharge chamber 22, steam discharge port 24 and steam discharge conduit 28. Similarly, a steam purge passageway can be established by steam inlet or supply conduit 26, steam inlet port 18, steam inlet chamber 20, bore 32, steam discharge chamber 22, bore 36, discharge port 38 and oil discharge conduit 40.

In accordance with the invention, a combined steam valve and actuator member is provided and is indicated generally at 42. The steam valve and actuator member 42 includes a valve having upper and lower portions 44, 46 which cooperate respectively with the steam valve seat 30 and the purge valve seat 34. An actuator portion of the member in the form of an elongated plunger or stem 48 has a function to be described more fully hereinbelow. Upwardly extending stem 50 associated with the valve and actuator member has a sealing or packing means 52 associated therewith and extends therefrom upwardly in FIG. 1 to an actuating means.

The actuating means for the steam valve and actuator member 42 may vary widely within the scope of the invention and may comprise pneumatic, hydraulic, electrical or other means. An illustrative actuating means indicated generally at 54 is of the pneumatic type. Two part housing 56, 58 for the actuator 54 comprises a lower cup shaped member secured in an upright position by nut 60 threadably engaged with an appropriate threaded stud 62 which is formed on and projects axially upwardly from the plug or closure 14. Upper housing member 58 takes an inverted cup shape and is secured to the lower cup member by means of suitable annular flanges respectively on the upper and lower members and secured together by appropriate screws or bolts 64. An atmospheric port or vent 66 is provided in the lower housing member 56 and a supply or control port 68 in the upper housing member 58 may be connected with a controlled source of air or other gas under pressure. Disposed within the actuator housing is a diaphragm 70 peripherally clamped between the housing flanges and attached to an upper end portion of the valve stem 50. A biasing or return spring 72, which may be of the coil type, has an upper end portion seated beneath the diaphragm 70 and a lower end portion seated on the bottom wall of the lower cup shaped housing member 56.

As will apparent, air or other gas under pressure may be supplied through the port 68 for actuation of the diaphragm 70, the stem 50 and its valve and actuator member 42, the spring 72 supplying the necessary biasing or reaction force. Moreover, it will apparent that appropriate control or regulation of air pressure will result in initial movement of the valve and actuator member 42 to an intermediate or purge position as illustrated by broken line 74. On an increase in the regulated pressure supplied through the port 68, further downward movement of the valve and actuator member 42 will occur to the broken line position of the valve illustrated at 76. In the reverse direction, a controlled reduction in supply pressure to the diaphragm 70 will allow the return spring 72 to urge the diaphragm, stem, and valve and actuator member upwardly to its closed full line position. Alternatively and if desired, a step reduction in pressure may be employed to move the valve and actuator member sequentially from its lower-most broken line position 76 to its intermediate broken line position at 74 for a purge operation, and thereafter to the full line closed position.

In the first, full line, or closed position of the steam valve, its upper generally frusto-conical portion 44 engages the steam seat 30 and a plug portion 77 thereabove enters the seat bore 32. Thus, the steam inlet or supply port 18 and chamber 20 are effectively isolated from the remainder of the valve passageways, ports, and conduits. In the second or intermediate broken line position 74, the frusto-conical seating surface 44 is displaced axially downwardly from the steam seat 30 whereby to open the steam inlet chamber 20 to the steam discharge chamber 22 through the bore 32 in the seat 30. Thus, a first passageway is provided interconnecting the steam inlet and discharge ports and comprises inlet port 18, steam inlet chamber, bore 32 etc. as set forth above. Steam discharge flow through the conduit or line 28, however, may be regarded as merely incidental, purging of steam lines not ordinarily being required.

Steam flow through the aforementioned purge passageway is, however, highly significant and results in the desired purging of the oil line or conduit 40. The second or purge passageway comprises steam inlet port 18, steam inlet chamber 20, bore 32, steam discharge chamber 22, bore 36, oil discharge port 38, and oil discharge conduit 40.

Figure 7:
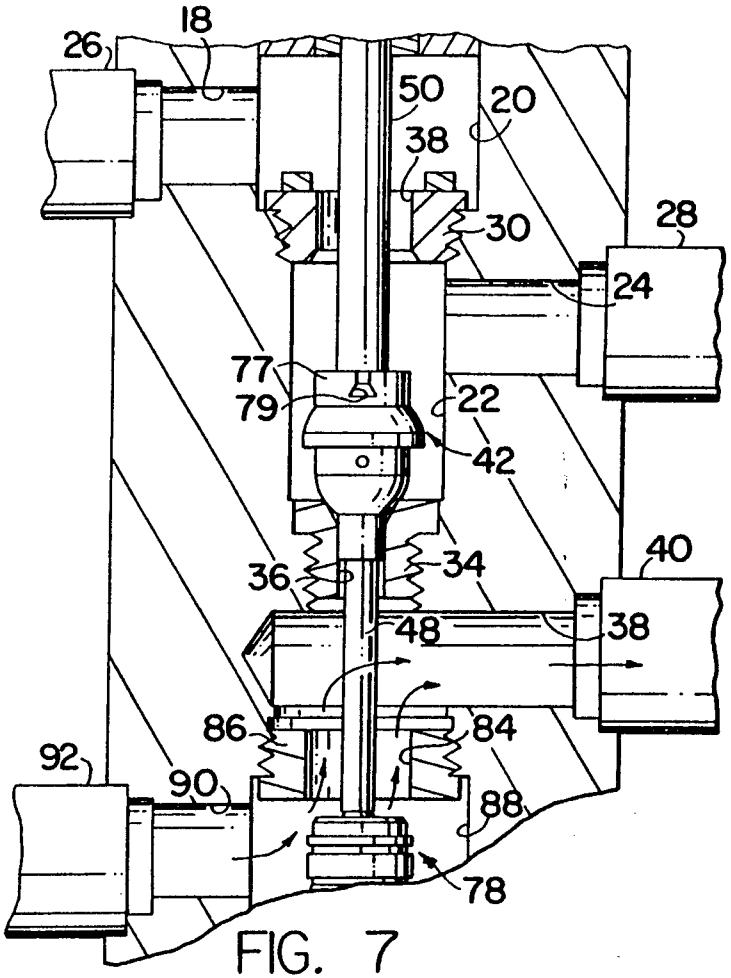
FIG. 7 is a view similar to FIGS. 4 and 6 but showing the valve and actuator member in a burner operating position with oil supplied to the burner from the valve.
Figure 6:
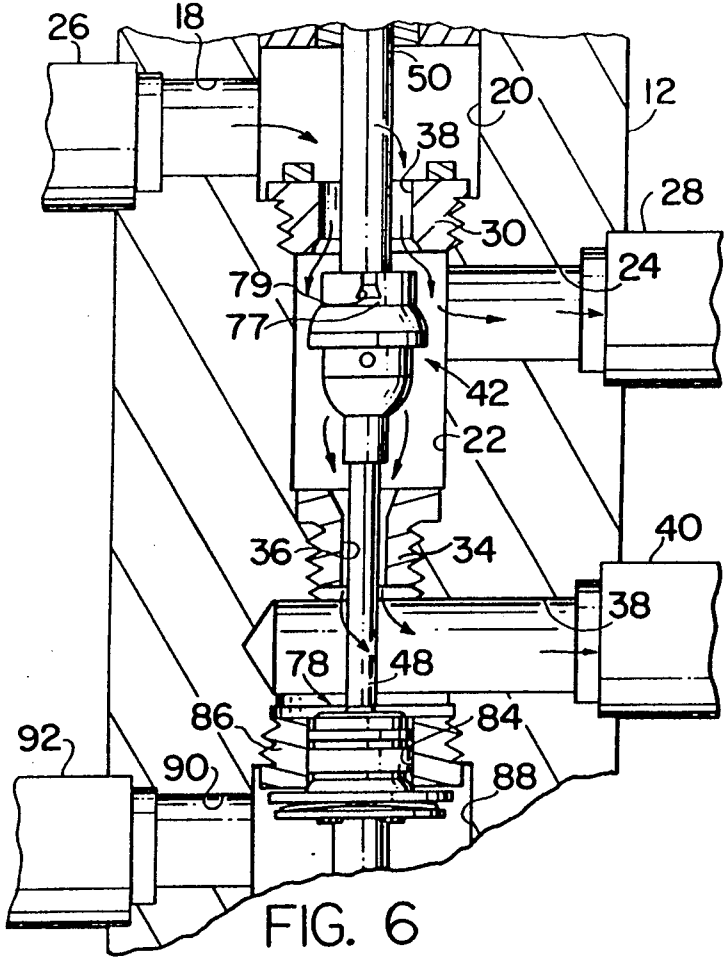
FIG. 6 is a view similar to FIGS. 4 and 5 but showing the valve and actuator member in the steam purge position.

When the steam valve and actuator member 42 is in its lower-most or third position, the lower portion 46 of the valve closes the bore 36 in the purge seat 34 as illustrated and steam discharge through the oil discharge conduit 40 is terminated. At the same time, the actuator stem 48 associated with the steam valve 42 engages an oil valve member, indicated generally at 78 in FIG. 6, and urges the same downwardly to its FIG. 7 position. In its FIG. 6 line position, the oil valve member 78 has a plug portion 82 which enters and closes a bore 84 in oil valve seat 86. In its lower or FIG. 7 position, the bore 84 is opened to an oil inlet chamber 88 therebeneath which in turn communicates with an oil inlet or supply port 90 and an oil supply conduit 92. Thus, an oil supply passageway is established from the supply conduit 92 through the port 90, chamber 88, bore 84 to the oil discharge port 38 and its associated discharge conduit 40. This condition of the valve members prevails with the oil burner in operation and with atomizing steam flowing through the discharge conduit 28 and fuel oil similarly flowing to the burner through the discharge conduit 40.

The oil valve 78 also has an associated stem 94 which extends downwardly therefrom past a sealing or packing device 96 to a biasing spring 98. The biasing spring 98 urges the oil valve member to its second or full line position at 78 and is compressed when the actuator member 48 urges the oil valve member downwardly to its first or broken line position at 80. An associated recirculation seat 100 has a plurality of small openings 102, 102 provided therein. That is, the stem 94 extends downwardly through a central bore in the seat 100 and the plurality of small valve openings 102, 102 are arranged circumaxially in the valve seat 100 about the central bore and the stem 94. At a lower portion thereof the valve 78 has a flat disc-like member 104 which cooperates with the valve openings 102, 102. Thus, with the valve member at its lowermost position 80, disc 104 serves to close the openings 102, 102. When the oil valve member is in its upper full line position 78 the openings 102, 102 are open and in communication with the oil inlet chamber 88. Thus, a recirculation chamber 106 beneath seat 100 receives oil from the openings 102, 102 and the oil in turn flows through a recirculation port 108 and a return conduit 110. As will be apparent, the viscosity of the oil may thus be maintained at a low level through re-heating in its storage tank whenever the oil valve member 78 is in its full line or closed position.

Figure 2:
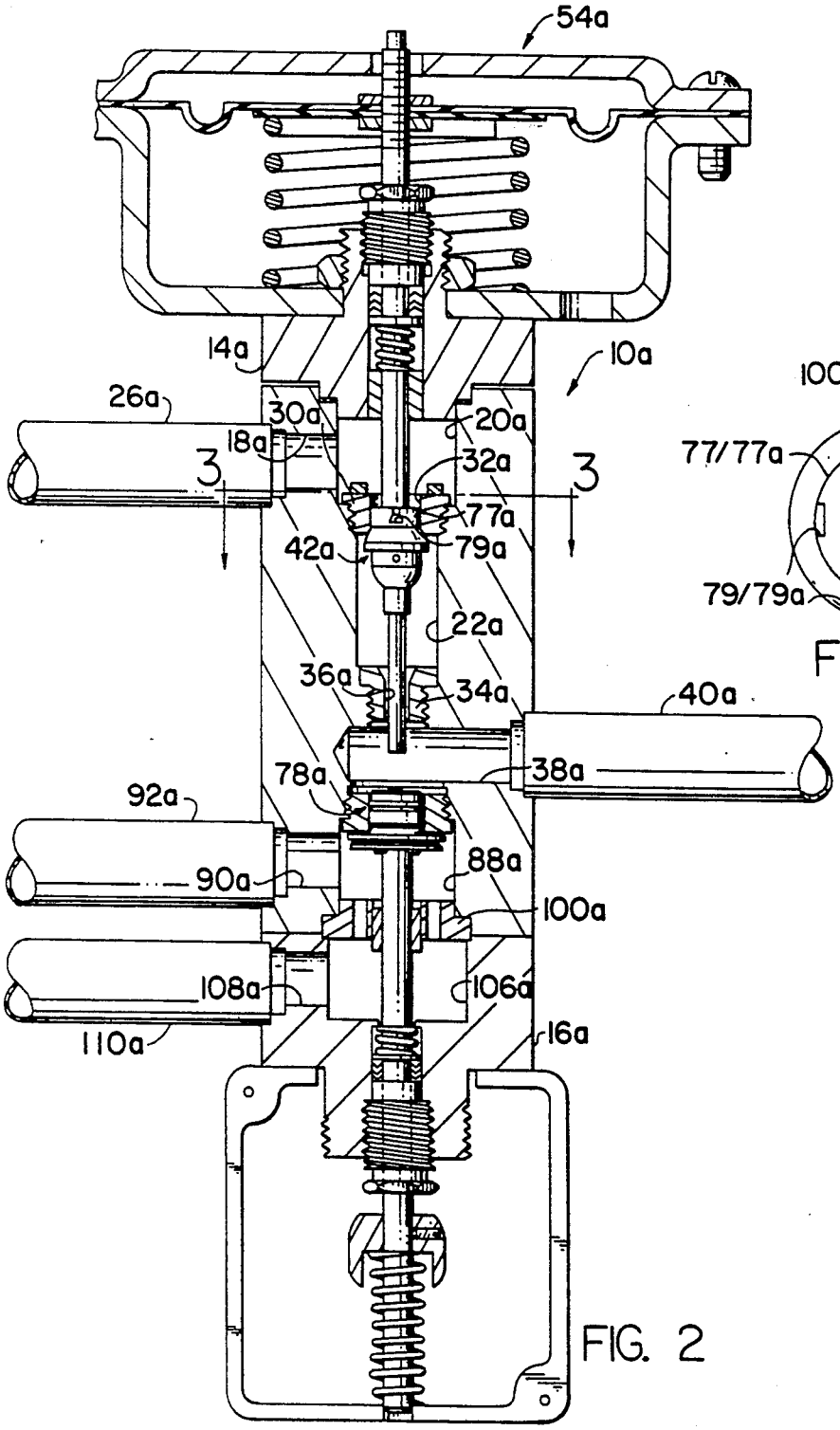
FIG. 2 is a vertical sectional view similar to FIG. 1 but showing a valve forming a second embodiment of the present invention, a single discharge port and conduit replacing the dual discharge ports and conduits of the valve of FIG. 1.

Referring now to FIG. 2, a valve construction **10*a* forming a second embodiment of the present invention may be employed advantageously with mechanically atomized burners not requiring steam flow to the burners for atomization during burner operation. The valve 10*a* may be substantially identical in all respects with the valve 10 of FIG. 1 except for the elimination of the steam discharge port 24 and its associated conduit 28. Thus, a single oil supply conduit 40*a* serves alternatively for a purge and oil supply or burner operation function. When steam valve and actuator member 42*a* is in the purge position as illustrated in broken line at 74*a*, steam flows from the supply conduit 26*a* through the steam inlet port 18*a*, steam inlet chamber 20*a*, bore 32*a* in seat 30*a*, chamber 22*a*, bore 36*a* in purge seat 34*a*, and to the oil discharge port 38*a* and conduit 40*a***.

Operation of the valve **10*a* of FIG. 2 for the supply of oil through the conduit 40*a* during burner operation is identical to that described above for valve 10 and the provisions for recirculation of the oil through the conduit 110*a*** may also be identical with those described above.

Figure 3:
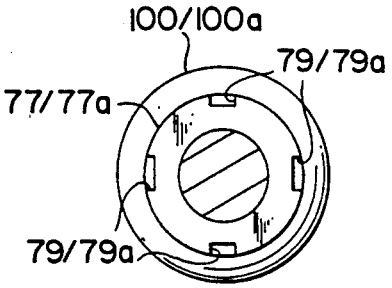
FIG. 3 is a fragmentary horizontal sectional view taken generally as indicated at 3, 3 in FIGS. 1 and 2 illustrating small cooling steam passageways.
Figure 5:
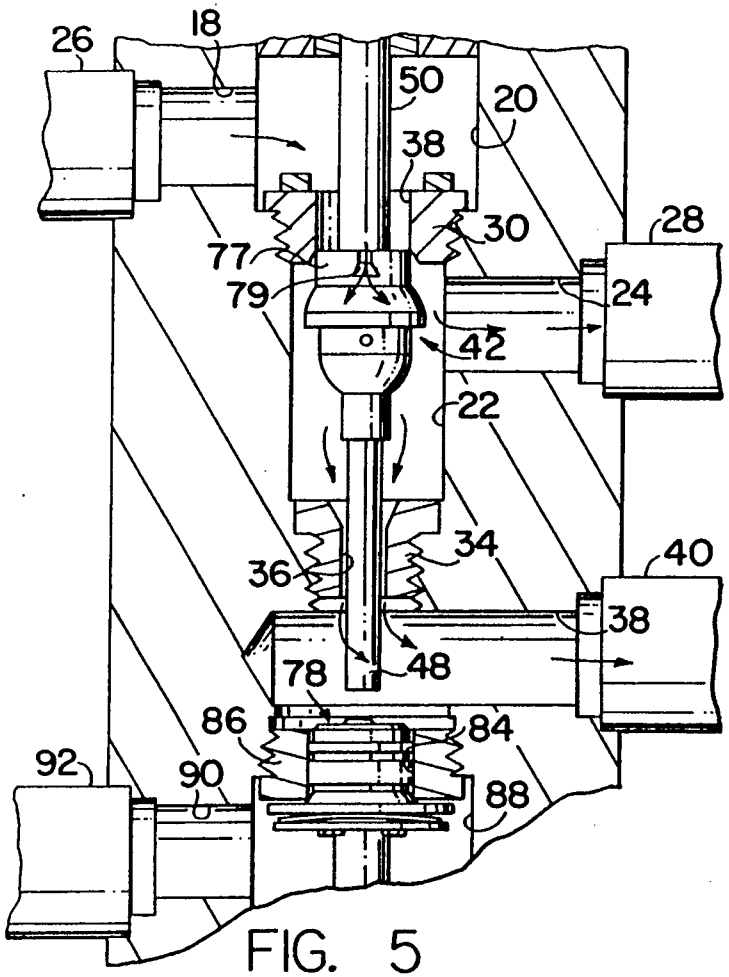
FIG. 5 is a view similar to FIG. 4 but showing the steam valve and actuator member in a cooling steam position wherein the cooling steam passageway is open.
Figure 4:
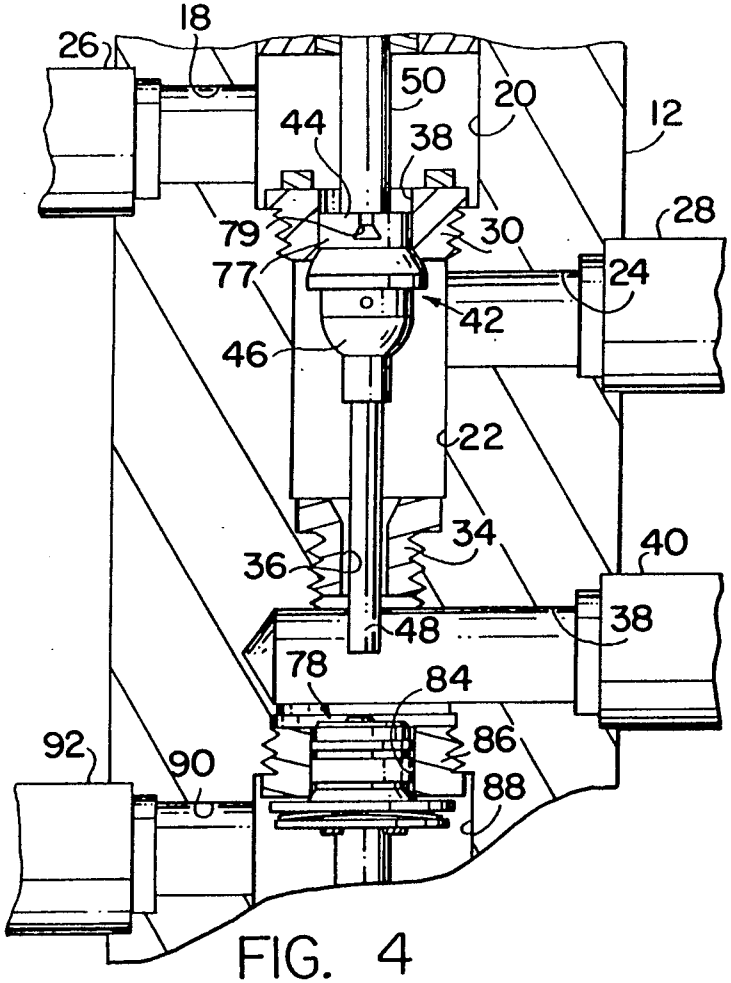
FIG. 4 is an enlarged fragmentary section of a portion of the improved valve illustrating a steam valve and actuator member in a position wherein all passageways through the valve portion thereof are closed.
Figure 9:
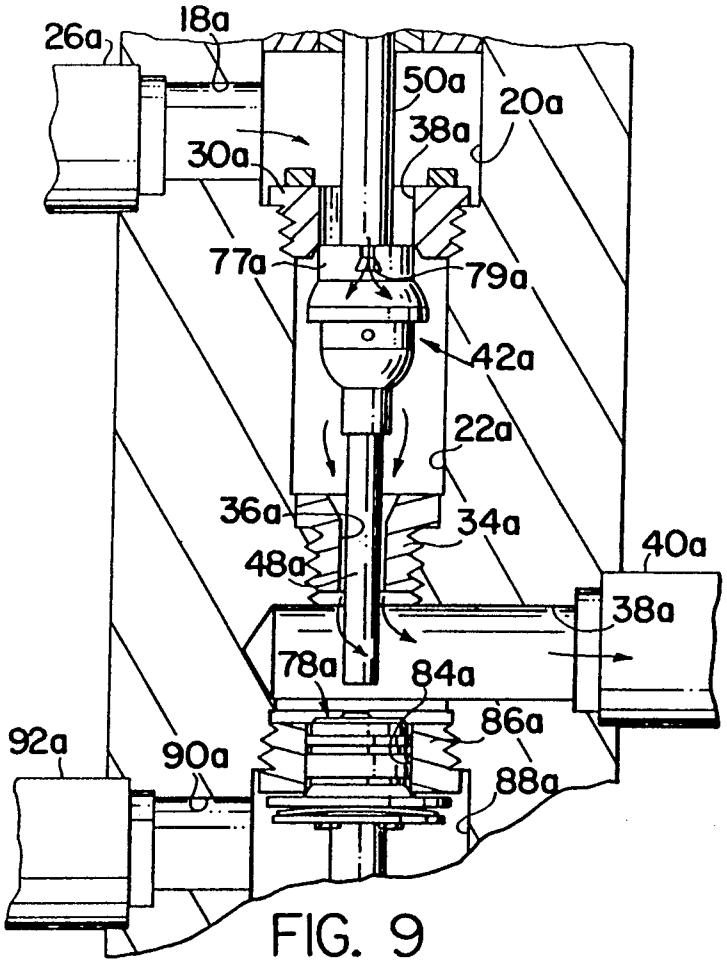
FIGS. 8 through 11 correspond precisely with FIGS. 4 through 7 but illustrate the valve of FIG. 2.
Figure 8:
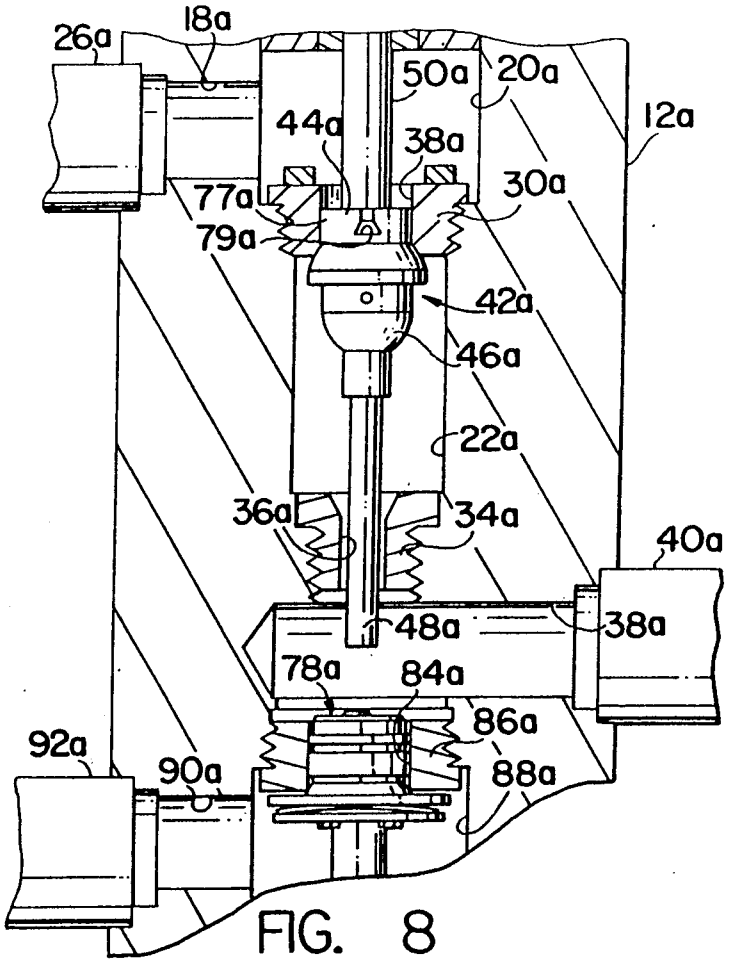
Figure 11:
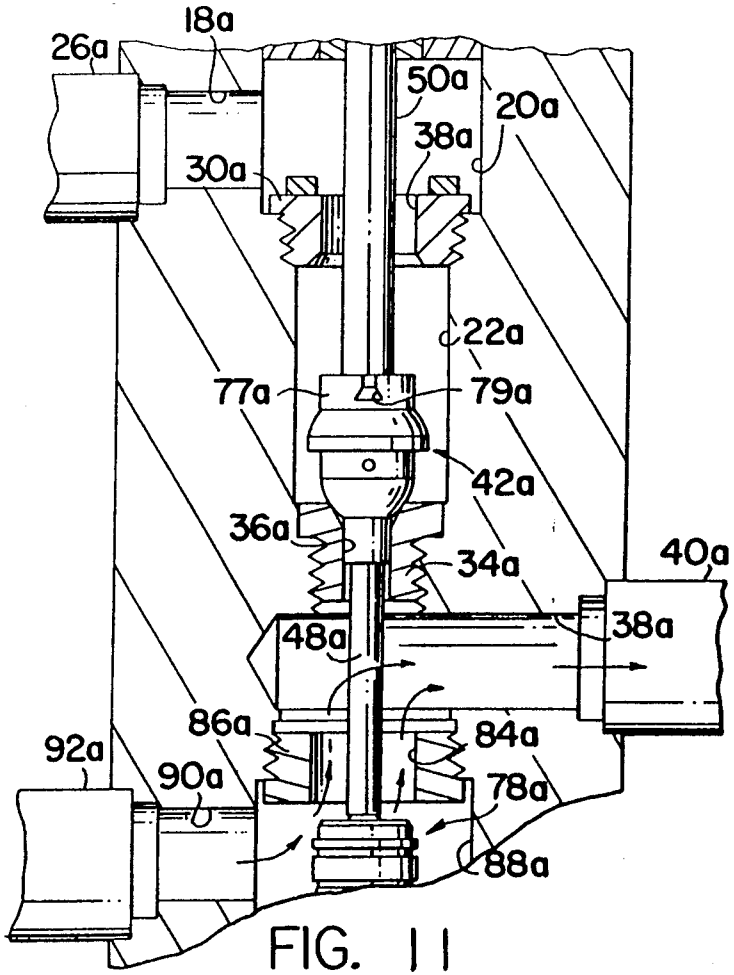
Figure 10:
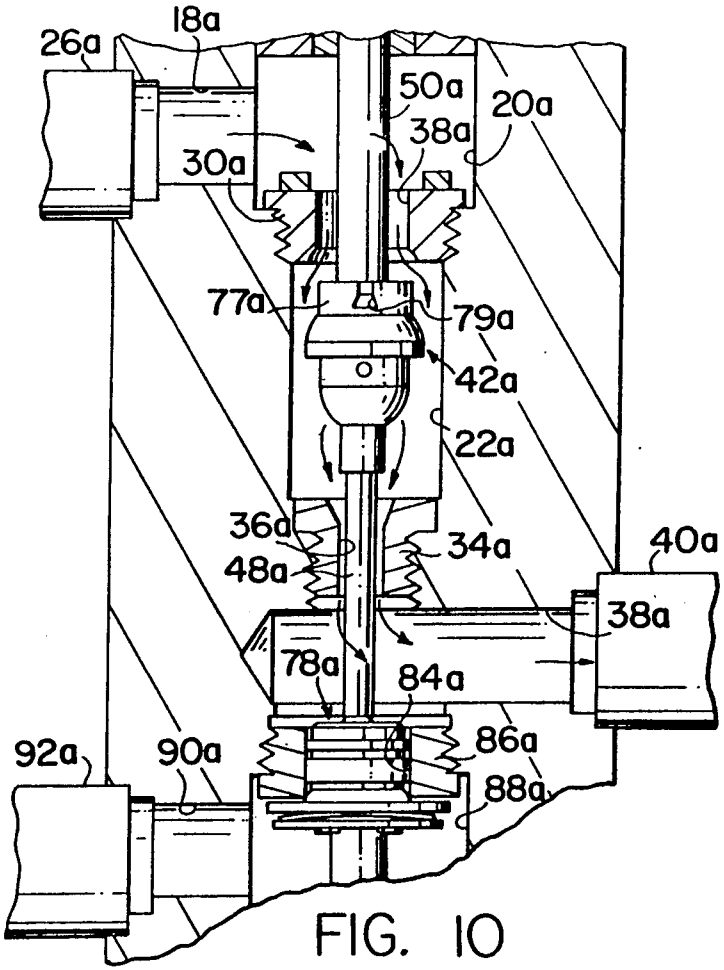

Referring now to both FIGS. 1 and 2, it will be observed that the plug **77/77*a* which forms a part of steam valve and actuator member 42/42*a* is provided with four (4) small passageways 79/79*a* best illustrated in FIG. 3. The passageways 79/79*a* serve to control and meter steam flow during a "cooling" steam phase of operation when one or more burners may be inactive with other burners remaining in operation. A cooling steam passageway is established when steam valve and actuator member 42/42*a* is moved to its fourth position as illustrated in FIGS. 5 and 9, an appropriate actuating pressure level having been established in actuator 54/54*a* through port 68/68*a*. The cooling steam passageway includes inlet port 18/18*a*, inlet chamber 20/20*a*, bore 32/32*a*, passageways 79/79*a*, bore 36/36*a*, port 38/38*a* and discharge conduit 40/40*a*. As will be apparent the passageways 79/79*a* are so dimensioned and located as to open prior to full opening movement of the valve portion of the valve and actuator member 42/42*a*. Thus, steam flow is under the control of small passageways 79/79*a*** and may be metered as required for efficient burner tip cooling.

From the foregoing, it will be apparent that a desirably simple and straight-forward cooling steam feature is provided in the steam and fuel oil supply and purge valve of the present invention. Burner tip cooling is achieved in an efficient and fool proof manner and a substantially improved valve construction and operation results.

I claim:

1. A steam and fuel oil supply and purge valve comprising a valve body defining steam and oil inlet ports, at least one discharge port, a steam purge passageway interconnecting said steam inlet and discharge ports, an oil supply passageway interconnecting said oil inlet and discharge ports, a cooling steam passageway interconnecting said steam inlet and discharge ports, a steam valve and actuator member movable between first, second, third, and fourth positions in said valve body and operable to open and close said steam purge and cooling steam passageways, a small metering passageway in said steam valve and actuator member which is so dimensioned and located as to open prior to full opening movement of the valve member and actuator relative to its seat, an oil valve member movable between first and second positions to open and close said oil supply passageway, biasing means urging said oil valve member toward its second and closed position, said steam valve and actuator member in its first and second positions respectively closing and opening said steam purge passageway, and said valve and actuator member in its third position closing said steam purge passageway and actuating said oil valve member whereby to urge said member to its first position in opposition to said biasing means and thereby open said oil supply passageway, and said steam valve and actuator member in its fourth position allowing said oil valve member to close said oil supply passageway at the urging of said biasing means and opening said cooling steam passageway.

2. A steam and fuel oil supply and purge valve as set forth in claim 1 wherein said steam valve member and actuator has at least a portion thereof which is of the plug type, wherein said member is provided with a valve seat having a bore for receiving said plug in a closed position of the valve member, and wherein said small passageway is provided in said plug for early opening of the bore as aforesaid.

3. A steam and fuel oil supply and purge valve as set forth in claim 1 wherein the valve is provided with an oil recirculation port and return conduit in communication with said oil supply port when the oil valve member is in its closed position.

4. A steam and fuel oil supply and purge valve comprising a valve body defining steam and oil inlet ports, steam and oil discharge ports, a steam purge passageway interconnecting at least said steam inlet and oil discharge ports, a steam supply passageway interconnecting said steam inlet and discharge ports, an oil supply passageway interconnecting said oil inlet and discharge ports, a cooling steam passageway interconnecting said steam inlet port and at least one of said discharge ports, a steam valve and actuator member movable between first, second, third, and fourth positions in said valve body and operable to open and close said steam purge and cooling steam passageways, a small metering passageway in said steam valve and actuator member which is so dimensioned and located as to open prior to full opening movement of the valve member and actuator relative to its seat, an oil valve member movable between first and second positions to open and close said oil supply passageway, biasing means urging said oil valve member toward its second and closed position, said steam valve and actuator member in its first and second positions respectively closing and opening said steam purge passageway, and said steam valve and actuator member in its third position closing said steam purge passageway, opening said steam supply passageway, and actuating said oil valve member whereby to urge said member to its first position in opposition to said biasing means and thereby open said oil supply passageway, and said steam valve and actuator member in its fourth position allowing said oil valve member to close said oil supply passageway at the urging of said biasing means and opening said cooling steam passageway.

5. A steam and fuel oil supply and purge valve as set forth in claim 4 wherein said steam valve member and actuator has at least a portion thereof which is of the plug type, wherein said member is provided with a valve seat having a bore for receiving said plug in a closed position of the valve member, and wherein said small passageway is provided in said plug for early opening of the bore as aforesaid.

6. A steam and fuel oil supply and purge valve as set forth in claim 4 wherein the valve is provided with an oil recirculation port and return conduit in communication with said oil supply port when the oil valve member is in its closed position.

7. A steam and fuel oil supply and purge valve comprising a valve body defining steam and oil inlet ports, a single discharge port, a steam purge passageway interconnecting said steam inlet port and said discharge port, and oil supply passageway interconnecting said oil inlet port and said discharge port, a cooling steam interconnecting said steam inlet port and said discharge port, a steam valve and actuator member movable between first, second, third and fourth positions in said valve body and operable to open and close said steam purge and cooling steam passageways, a small metering passageway in said steam valve and actuator member which is so dimensioned and located as to open prior to full opening movement of the valve member and actuator relative to its seat, an oil valve member movable between first and second positions to open and close said oil supply passageway, biasing means urging said oil valve member toward its second and closed position, said steam valve and actuator member in its first and second positions respectively closing and opening said steam purge passageway, and said valve and actuator member in its third position closing said steam purge passageway and actuating said oil valve member whereby to urge said member to its first position in opposition to said biasing means and thereby open said oil supply passageway, and said steam valve and actuator member in its fourth position allowing said oil valve member to close said oil supply passageway a the urging of said biasing means and opening said cooling steam passageway.

8. A steam and fuel oil supply and purge valve as set forth in claim 7 wherein said steam valve member and actuator has at least a portion thereof which is of the plug type, wherein said member is provided with a valve seat having a bore for receiving said plug in a closed position of the valve member, and wherein said small passageway is provided in said plug for early opening of the bore as aforesaid.

9. A steam and fuel oil supply and purge valve as set forth in claim 7 wherein the valve is provided with an oil recirculation port and return conduit in communication with said oil supply port when the oil valve member is in its closed position.

* * * * *